US007811139B1

(12) United States Patent
Parikh et al.

(10) Patent No.: US 7,811,139 B1
(45) Date of Patent: Oct. 12, 2010

(54) MULTI-PORT CABLE CONNECTOR WITH TWO-STAGE RETENTION CLIPS

(75) Inventors: Hardik Parikh, Danbury, CT (US); Owen R. Barthelmes, Putnam Valley, NY (US); Gino S. Antonini, New Fairfield, CT (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/407,576

(22) Filed: Mar. 19, 2009

(51) Int. Cl.
*H01R 13/514* (2006.01)

(52) U.S. Cl. ..... 439/752

(58) Field of Classification Search ..... 439/752, 439/701, 362, 733.1, 540.1
See application file for complete search history.

(56) References Cited

U.S. PATENT DOCUMENTS

| | | | | |
|---|---|---|---|---|
| 3,243,760 | A | 3/1966 | Dupre et al. | |
| 3,648,223 | A | 3/1972 | McCray | |
| 4,131,330 | A | 12/1978 | Stupay | |
| 4,302,066 | A | 11/1981 | Newman et al. | |
| 4,544,225 | A | 10/1985 | Raus et al. | |
| 4,738,626 | A | 4/1988 | Reichle | |
| 5,021,001 | A | 6/1991 | Ramirez | |
| 5,207,593 | A | 5/1993 | Bogiel | |
| 5,637,009 | A | 6/1997 | Tsuji et al. | |
| 6,098,131 | A | 8/2000 | Unger et al. | |
| 6,155,862 | A | 12/2000 | Chiu et al. | |
| 7,041,903 | B2 | 5/2006 | Odahara et al. | |
| 7,297,012 | B1 | 11/2007 | Hwang et al. | |
| 7,384,306 | B2 * | 6/2008 | Malstrom et al. | 439/578 |
| 7,682,205 | B2 * | 3/2010 | Hall et al. | 439/752 |

FOREIGN PATENT DOCUMENTS

| | | |
|---|---|---|
| DE | 3709461 | 10/1987 |
| JP | 5299134 | 11/1993 |

* cited by examiner

*Primary Examiner*—Phuong K Dinh
(74) *Attorney, Agent, or Firm*—Blank Rome LLP

(57) ABSTRACT

A device of and method for making a multi-port cable connector is disclosed. The device comprises a connector housing having a plurality of orifices and a clip receiving portion extending into each orifice, each orifice being adapted to receive a corresponding cable connector therein and each clip receiving portion including, at least one grooved engagement surface disposed in a sidewall of the clip receiving portion and defining a first stage, and at least one second grooved engagement surface disposed below the at least one first grooved engagement surface in a sidewall of the clip receiving portion and defining a second stage; and comprises a plurality of retention clips adapted to slide between the first stage and the second stage in a corresponding clip receiving portion, each retention clip including a pair of engagement arms having a notched engagement surface for alternately engaging the pair of first engagement surfaces and the pair of second engagement surfaces.

22 Claims, 5 Drawing Sheets

MULTI-PORT CABLE CONNECTOR WITH TWO-STAGE RETENTION CLIPS

FIELD OF THE INVENTION

The present invention relates to a new and useful mounting device for cable connectors. More particularly, the present invention relates to a multi-port mounting device for cable connectors with two-stage retention clips.

BACKGROUND OF THE INVENTION

The broadband services market has experienced tremendous worldwide growth in recent years and continues to grow. In telecommunications, broadband refers to a signaling method that includes or handles a relatively wide range of signal frequencies. Those signals can be carried over a communication path via a static connection made with some type of cable, e.g., optical fiber or electrical conductor, or via some form of energy without the use of cables, e.g., radio frequency (RF), infrared light, laser light, fiberless visible light, and acoustic energy. Cable television (CATV), cable internet, digital subscriber lines (DSL), isolated subscriber digital networks (ISDN), and local area networks (LAN) are among the cabled, or "wired", broadband services now provided.

CATV transmits digital and analog television signals to televisions via optical fiber cables, coaxial cables, or a combination thereof in a hybrid fiber-coaxial (HFC) network. Cable internet utilizes the CATV infrastructure to transmit various forms of digital data over a wide area network (WAN) of interconnected computers via optical fibers and coaxial cables. And, just as cable internet is layered on top of the existing CATV network infrastructure, DSL and ISDN utilize the existing telephone network infrastructure to transmit various forms of digital data over a WAN via copper telephone wires. Unlike WANs, LANs are networks of interconnected computers covering a small physical area, such as an office building. Various forms of digital data can be transmitted over LANs using optical fibers, coaxial cables, or copper twisted pair cables.

At the heart of the infrastructure that makes up each of those forms of broadband service, service providers often utilize a central control device called a headend. Headends serve as trunks, or nodes, in spanning tree networks that receive, process, and distribute signals into the service provider's network. In larger networks, e.g., WANs, headends may connect to distribution systems or other headends, which may further connect to other distributions systems or headends. Accordingly, each headend may include hundreds of cable connectors for making the numerous network connections required.

The increased number of network connections at the headend leads to significant difficulties when connecting and disconnecting cables at the headend. When cables are individually connected to the headend, each cable connector typically includes some type of fastening means, such as a threaded collar, to maintain a connection with the headend. Not only must each connection be disconnected and reconnected if, for example, the module to which they are connected needs to be replaced, the density with which those connections are arranged on the headend makes it difficult to access the fastening means on each connector, such as with a wrench.

In response to the difficulties encountered when individually connecting and disconnecting cables at the headend, high-density multi-port cable connectors, or gang connectors, have been developed to allow a large number of connections to be simultaneously made and broken using a single connector housing. The cable connections are maintained with the headend using only a few fastening means, such as two jack screws, on the gang connector housing in lieu of using fastening means on each of the individual cables. The individual cables, however, maintain their connection with the gang connector housing with fastening means, such as retention clips, that are not accessible while the gang connector housing is connected to the headend. Accordingly, none of those gang connectors allows individual cables to be connected or disconnected without disconnecting the entire gang connector housing when a single cable requires maintenance. Instead, all of the cables must be disconnected with the gang connector to access a single cable, which results in the disruption of service to all of the other cables in the gang connector that must also be disconnected.

Accordingly, there is a need for a device of and method for a gang connector that allows a large number of cables to be connected or disconnected to a headend at the same time while simultaneously allowing the cables to be connected and disconnected individually without disconnecting the entire gang connector.

SUMMARY OF THE INVENTION

Accordingly, to solve at least the above problems and/or disadvantages and to provide at least the advantages described below, a non-limiting object of the present invention is to provide a device of and method for making a multi-port cable connector comprising a connector housing having a plurality of orifices and a clip receiving portion extending into each orifice, each orifice being adapted to receive a corresponding cable connector therein and each clip receiving portion including, at least one grooved engagement surface disposed in a sidewall of the clip receiving portion and defining a first stage, and at least one second grooved engagement surface disposed below the at least one first grooved engagement surface in a sidewall of the clip receiving portion and defining a second stage; and comprising a plurality of retention clips adapted to slide between the first stage and the second stage in a corresponding clip receiving portion, each retention clip including a pair of engagement arms having a notched engagement surface for alternately engaging the pair of first engagement surfaces and the pair of second engagement surfaces.

These and other objects of the invention, as well as many of the intended advantages thereof, will become more readily apparent when reference is made to the following description, taken in conjunction with the accompanying drawings.

DETAILED DESCRIPTION OF THE INVENTION

Figure 1:
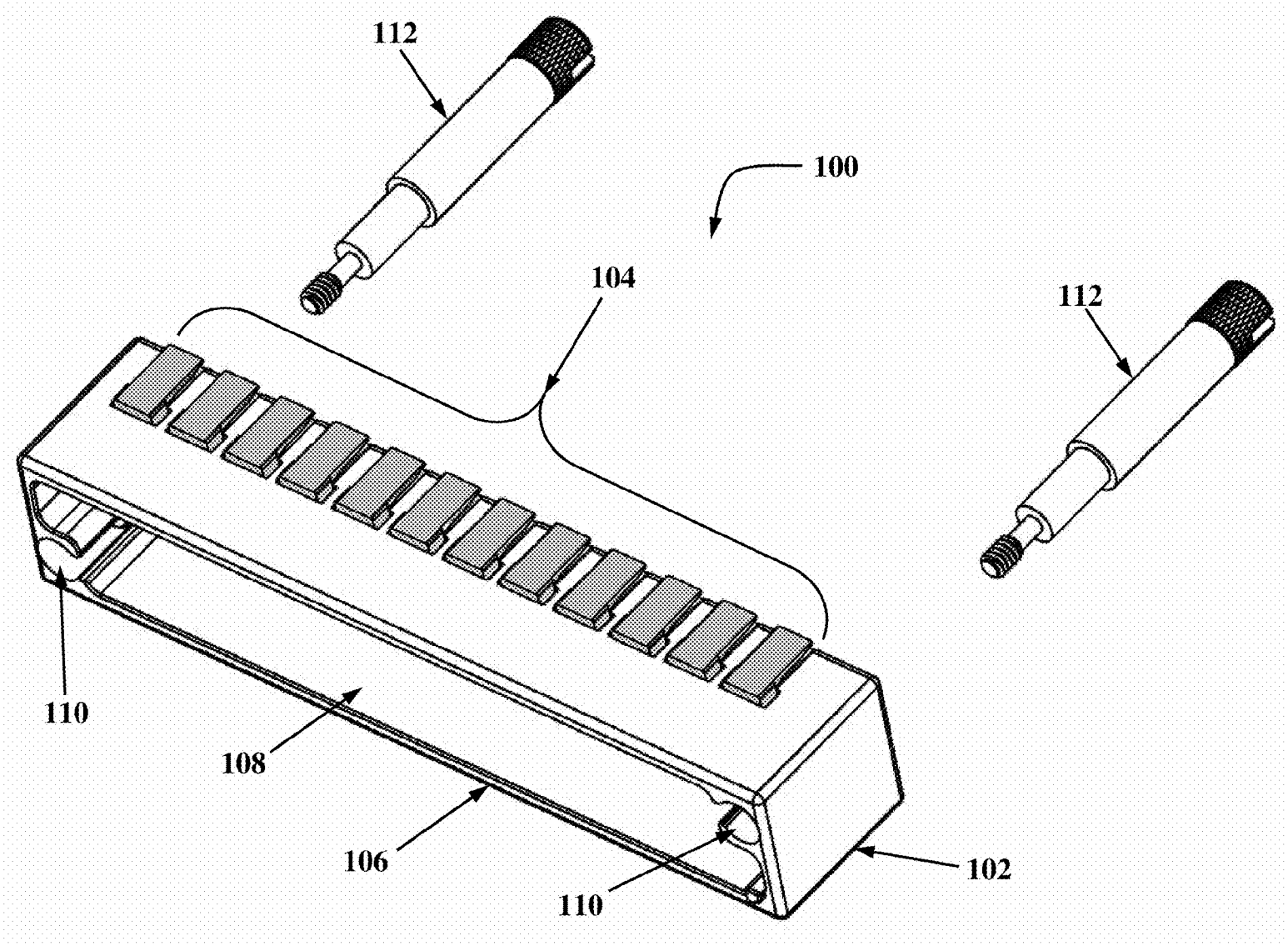
FIG. 1 is an orthogonal view illustrating a non-limiting exemplary embodiment of a multi-port cable connector with two-stage retention clips according to the present invention.

Reference will now be made in detail to non-limiting embodiments of the present invention by way of reference to the accompanying drawings, wherein like reference numerals refer to like parts, components, and structures.

Turning to the figures, FIG. 1 illustrates a multi-port cable connector 100 according to a non-limiting embodiment of the present invention. The multi-port cable connector 100 includes a connector housing 102 and a plurality of two-stage retention clips 104. The retention clips 104 are accessible for an area behind the multi-port cable connector 100 when the multi-port cable connector 100 is installed on an electronic component, such as a headend (not shown). The retention clips 104 are adapted to slide between at least a first location, or stage, (FIGS. 1, 2A, and 2B) and a second location, or stage, (FIGS. 2C, 2D, and 6) within the connector housing 102. In the second stage (FIGS. 2C, 2D, and 6), the retention clips engage 104 a single cable connector, such as the cable connector 500 illustrated in FIG. 5, to retain the cable connector within the connector housing 102. And, in the first stage (FIGS. 1, 2A, and 2B), the retention clips 104 do not engage the respective cable connector so that the cable connector may be removed from the connector housing 102. Accordingly, because each of the retention clips 104 is accessible from an area behind the multi-port cable connector 100, each retention clip 104 can be moved between the first stage (FIGS. 1, 2A, and 2B) and the second stage (FIGS. 2C, 2D, and 6) to install and remove individual cable connectors without removing the entire multi-port cable connector 100 from the electronic component on which it is installed. Each retention clip 104 may be installed in the connector housing 102 and/or removed from the first stage (FIGS. 1, 2A, and 2B) to the second stage (FIGS. 2C, 2D, and 6) by applying a downward force, i.e., a force towards the connector housing 102, to the retention clip 104. And, each retention clip 104 may be moved from the second stage (FIGS. 2C, 2D, and 6) to the first stage (FIGS. 1, 2A, and 2B) and or removed from the connector housing 102 by applying an upward force, i.e., a force away from the connector housing 102, to the retention clip 104.

The connector housing 100 may include a circumferential rim 106 at a leading end of the connector housing 100 that defines a cavity 108 therein where individual cable connectors mate with corresponding connectors on the electronic component, thereby protecting the individual connectors from fouling or shorting. The connector housing 102 also includes a pair of cylindrical first orifices 110 extending therethrough, each of which is adapted to receive a jacking screw 112 therein for attaching the connector housing 102 to the electronic component.

The connector housing 102 also may include a plurality of cylindrical second orifices 200, a plurality of clip receiving portions 202, a plurality of tongue recesses 204, a trailing wall 206, an upper wall 208, and a lower wall 210. Each of the second orifices 200 may extend through the trailing wall 206 of the connector housing 102 into the cavity 108 of the connector housing 102 and is adapted to receive a cable connector 500 therein (see, e.g., FIG. 6). Each of the clip receiving portions 202 may extend through either the upper wall 208 or the lower wall 210 of the connector housing 102 (the upper wall 208 being illustrated as an example) into a leading end of a corresponding second orifice 200 and is adapted to receive one of the retention clips 104 positioned in the first stage (FIGS. 1, 2A, and 2B) and the second stage (FIGS. 2C, 2D, and 6) therein. And, each tongue recess 204 is disposed in the upper wall 208 (or lower wall 210) of the connector housing 102 and is adapted to receive a tongue portion 302 (FIG. 3A) of each corresponding retention clip 104 therein such that each retention clip 104 is substantially flush with the upper wall 208 (or lower wall 210) of the connector housing 102 when positioned in the second stage (FIGS. 2C, 2D, and 6).

The upper wall 208 and lower wall 210 extend substantially perpendicular to the trailing wall 206. The first orifices 110, second orifices 200, and tongue recesses 204 extend substantially parallel to the upper wall 208 and lower wall 210. The clip receiving portions 202 extend substantially perpendicular to the upper wall 208 and lower wall 210. The connector housing 102 may be formed from a lightweight dielectric material, such as 15% glass filled Polybutylene Terephthalate (PBT), to achieve the required geometry while reducing weight and satisfying the requirements of Underwriters Laboratories (UL) flammability testing, such as the V-0 vertical rating. The connector housing 102 include any number of second orifices 200, such as twenty-four, for receiving corresponding number of cable connectors 500 therein.

Figure 3A:
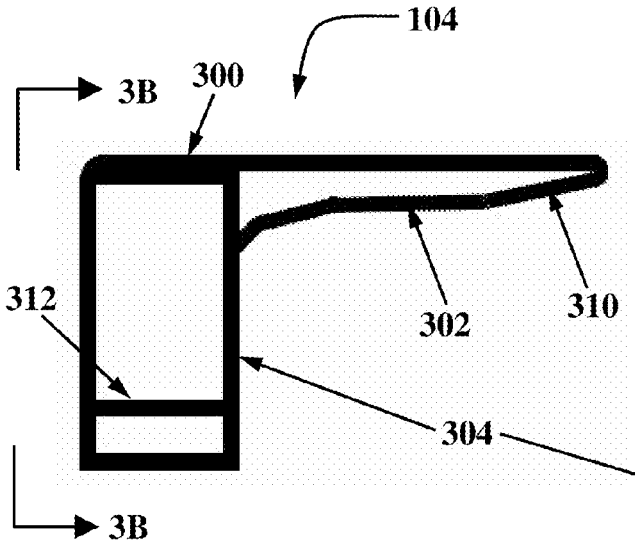
FIG. 3A is side elevational view illustrating a non-limiting embodiment of a retention clip of the connector according to the present invention.
Figure 3B:
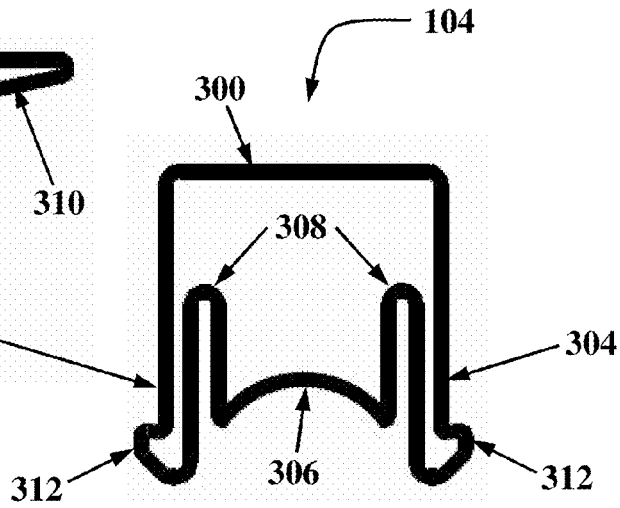
FIG. 3B is a front elevational view of the retention clip illustrated in FIG. 3A, taken along line 3B.

As FIGS. 3A and 3B illustrate, each retention clip 104 may include a main body 300, a tongue portion 302, and a pair of engagement arms 304. The main body 300 is of a substantially rectangular cross section that is adapted to allow each retention clip 104 to be slideably disposed in a corresponding rectangular orifice 410 (FIG. 4) in each clip receiving portion 202. The main body 300 may include a rounded engagement surface 306 with a rounded edge extending downward from the main body 300 that is adapted to engage a corresponding annular groove 502 in a cable connector 500 disposed in a second orifice 200 of the connector housing 102 when the retention clip 104 is positioned in the second stage (see, e.g., FIG. 6).

Figure 2A:
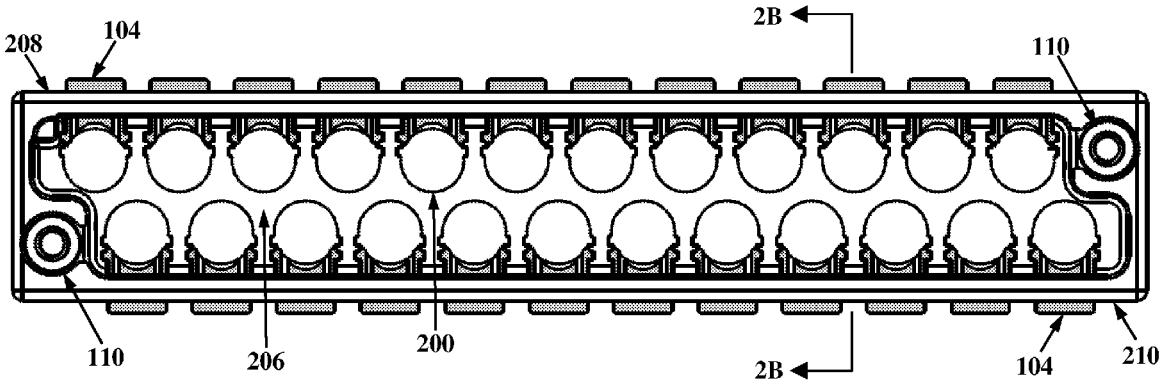
FIG. 2A is a front elevational view illustrating the multi-port cable connector of FIG. 1 with the retention clips positioned in a first stage.
Figure 2B:
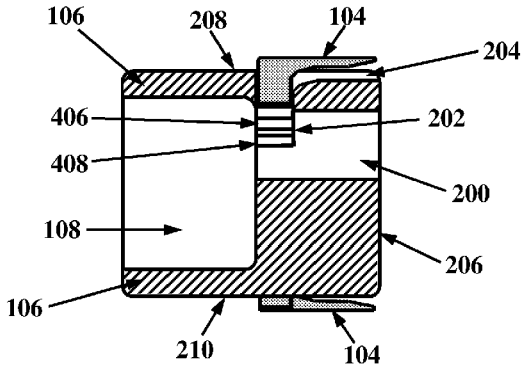
FIG. 2B is a sectional view of the multi-port cable connector illustrated in FIG. 2A, taken along line 2B.
Figure 2C:
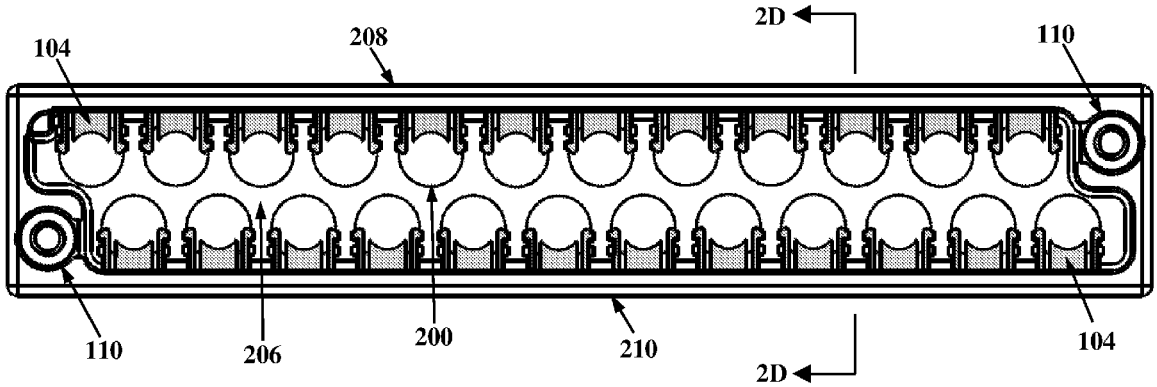
FIG. 2C is a front elevational view illustrating the multi-port cable connector of FIG. 1 with the retention clips positioned in a second stage.
Figure 2D:
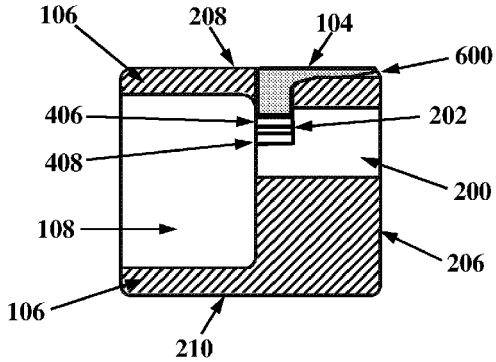
FIG. 2D is a sectional view of the multi-port cable connector illustrated in FIG. 2C, taken along line 2D.
Figure 6:
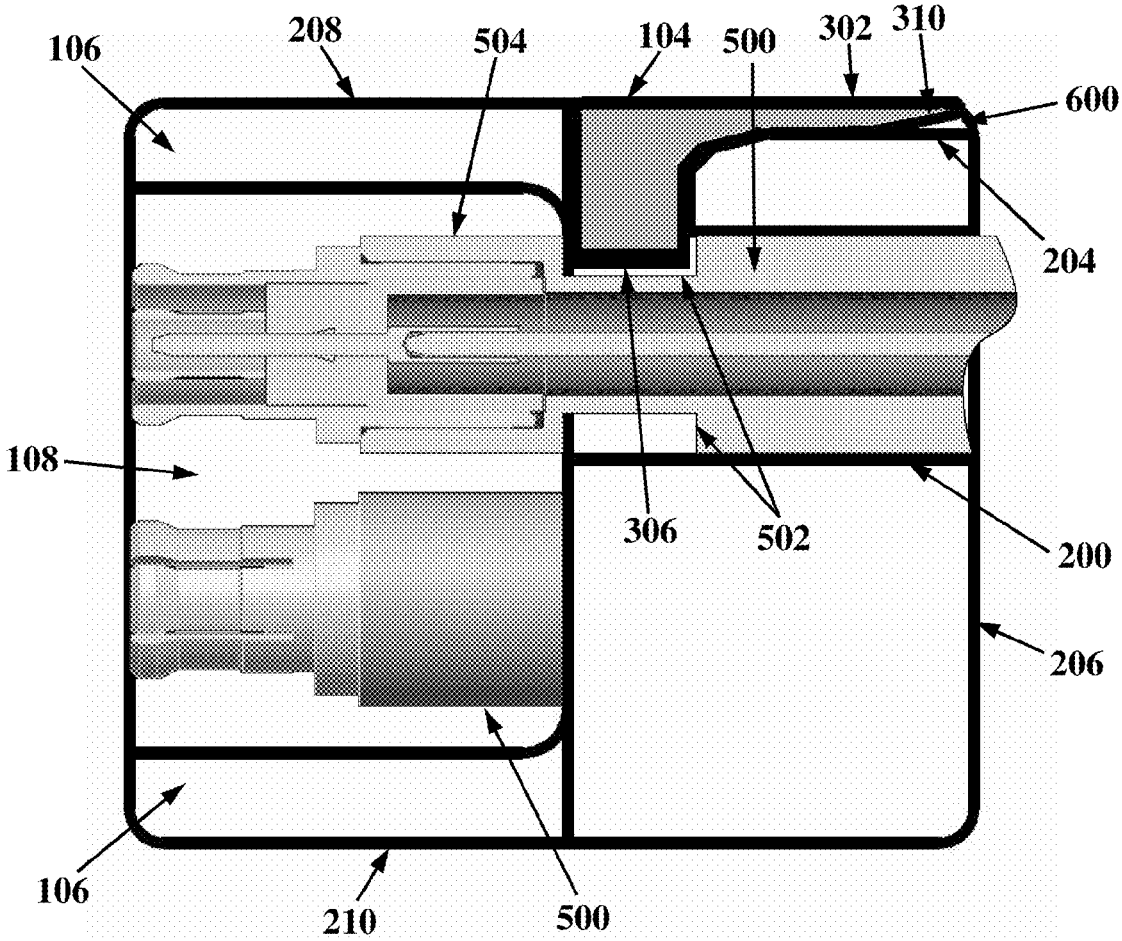
FIG. 6 is a sectional view illustrating a non-limiting exemplary embodiment of the multi-port cable connector according to the present invention with a retention clip positioned in a second stage and a cable connector installed therein.

The tongue portion 302 extends rearward from the main body 300 substantially perpendicular to the rounded engagement surface 306 and is adapted to provide leverage when moving the retention clip 104 between the first stage (FIGS. 1, 2A, and 2B) and the second stage (FIGS. 2C, 2D, and 6). The engagement arms 304 extend from the main body 300 substantially perpendicular to the tongue portion 302 and parallel to the rounded engagement surface 306 and are adapted to engage corresponding first grooved engagement surfaces 406 and second grooved engagement surfaces 408 (FIG. 4) in the clip receiving portions 202 of the connector housing 102. Each of the engagement arms 304 is spaced apart from the rounded engagement surface 306 of the main body 300 by a corresponding cutaway flexing portion 308 that extends substantially parallel to and between each engagement arm 304 and the rounded engagement surface 306. The cutaway flexing portions 308 are adapted to allow each respective engagement arm 304 to resiliently bias towards the rounded engagement surface 306 and disengage the first grooved engagement surfaces 406 or second grooved engagement surfaces 408 in the clip receiving portions 202 so the retention clip can be moved between the first stage (FIGS. 1, 2A, and 2B) and the second stage (FIGS. 2C, 2D, and 6). Accordingly, enough upward force or downward force must be applied to each retention clip 104 to bias its engagements arms 304 towards its rounded engagement surface 306 when removing or installing the retention clip 104 and when moving the retention clip 104 back and forth between the first stage (FIGS. 1, 2A, and 2B) and the second stage (FIGS. 2C, 2D, and 6).

The tongue portion 302 includes a chamfered edge 310 that is adapted to create a tool access 600 (FIG. 6) between the tongue recess 204 of the connector housing 102 and the tongue portion 302 for receiving the tip of a standard tool and providing additional leverage when moving the retention clip 104 between the first stage (FIGS. 1, 2A, and 2B) and the second stage (FIGS. 2C, 2D, and 6). The engagement arms 304 include notched engagement surfaces 312 for engaging corresponding first grooved engagement surfaces 406 and second grooved engagement surfaces 408 (FIG. 4) in the clip receiving portions 202. The notched engagement surfaces 312 may be substantially triangular in shape to create a ridge that protrudes from each engagement arm 304. The tongue portion 302 and the engagement arms 304 may be integrally formed with the main body 300 from a single piece of material by any suitable process, such as injection molding. The retention clip 104 may be formed from a lightweight dielectric material, such as 15% glass filled PBT, to achieve the required geometry while allowing the engagement arms to resiliently bias over a large number of cycles, reducing weight, and satisfying the requirements of UL flammability testing, such as the V-0 vertical rating.

Figure 4A:
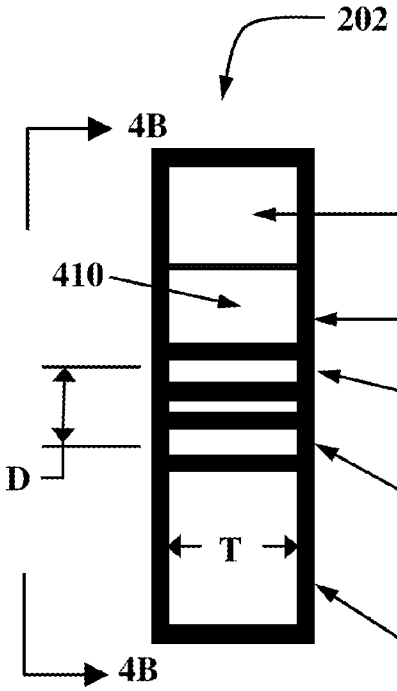
FIG. 4A is side elevational view illustrating a non-limiting embodiment of a clip of the connector receiving portion according to the present invention.
Figure 4B:
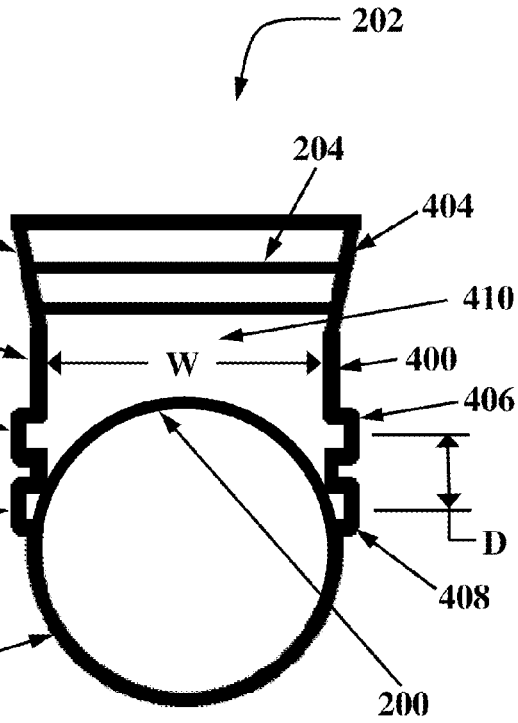
FIG. 4B is a front elevational view of the clip receiving portion illustrated in FIG. 4A, taken along line 4B.

As FIGS. 4A and 4B illustrate, each clip receiving portion 202 includes a pair of sidewalls 400, a rounded lower surface 402, a flared opening portion 404, a pair of first grooved engagement surfaces 406, and a pair of second grooved engagement surfaces 408. Each sidewall 400 extends substantially tangent to the circumference of the rounded lower surface 402 of the clip receiving portion 202 and substantially perpendicular to the upper wall 208 (or lower wall 210) of the connector housing 102 such that the sidewalls 400 form a substantially rectangular orifice 410 of thickness "T" and width "W" of approximately the same dimension as that of the diameter of the rounded lower surface 402. The rounded lower surface 402 is of substantially the same diameter as the corresponding second orifice 200 into which the clip receiving portion 202 extends such that each clip receiving portion 202 is integrally formed with its corresponding second orifice 200.

The flared opening portion 404 extends from the top of the rectangular orifice 410 through the upper wall 208 (or lower wall 210) of the connector housing 102. The flared opening portion 404 is of substantially the same thickness "T" and width "W" as the rectangular orifice 410 where the two intersect, but the width of the flared opening portion 404 increases as the flared opening portion 404 extends away from the rectangular orifice 410. The larger opening provided by the flared opening portion 404 at the top of each clip receiving portion 202 guides the individual retention clip 104 into each clip receiving portion 202, such as when the multi-port cable connector 100 is being assembled.

The pair of first grooved engagement surfaces 406 and pair of second grooved engagement surfaces 408 are disposed in the sidewalls 400 of the clip receiving portion 202 between the rounded lower surface 402 and the flared opening portion 404. The pair of first grooved engagement surfaces 406 are disposed above the pair of second grooved engagement surfaces 408, closer to the flared opening portion 404. The pair of first grooved engagement surfaces 406 are disposed a predetermined distance "D" from the pair of second grooved engagement surfaces 408 so that there is a portion of sidewall 400 disposed therebetween that physically separates the pair of first grooved engagement surfaces 406 from the pair of second grooved engagement surfaces 408.

Each pair of first grooved engagement surfaces 406 and second grooved engagement surfaces 408 is adapted to receive the notched engagement surfaces 312 on a corresponding pair of engagement arms 304 of a retention clip 104. When the engagement surfaces 312 are disposed in the pair of first grooved engagement surfaces 406, the retention clip 104 will be positioned in the first stage (FIGS. 1, 2A, and 2B) within the clip receiving portion 202. And, when the engagement surfaces 312 are disposed in the pair of second grooved engagement surfaces 408, the retention clip 104 will be positioned in the second stage (FIGS. 2C, 2D, and 6) within the clip receiving portion 202. In addition, individual retention clips 104 may be entirely removed from its corresponding clip receiving portion 202, which allows a user to repair or replace individual retention clips 104 within the connector housing 102 when a retention clip fails or breaks without replacing the entire multi-port cable connector 100.

When a retention clip 104 is positioned in the second stage (FIGS. 2C, 2D, and 6) within the clip receiving portion 202, the tongue 302 of the retention clip 104 is disposed in the corresponding tongue recess 204 of the connector housing 102 such that the main body 300 and tongue portion 302 of the retention clip 104 are substantially flush with the upper wall 208 (or lower wall 210) of the connector housing 102. And, when a retention clip 104 is positioned in the first stage (FIGS. 1, 2A, and 2B) within the clip receiving portion 202, the main body 300 and tongue portion 302 of the retention clip 104 extend beyond the upper wall 208 (or lower wall 210) of the connector housing 102 a distance substantially equal to the distance "D". Accordingly, there is a clear and visible difference between a retention clip 104 positioned in the first stage (FIGS. 1, 2A, and 2B) and a retention clip 104 positioned in the second stage (FIGS. 2C, 2D, and 6). That difference allows a user to visually and easily identify which retention clips 104 are positioned in either the first stage (FIGS. 1, 2A, and 2B) or the second stage (FIGS. 2C, 2D, and 6).

The position of each retention clip 104 is important because it indicates whether that retention clip 104 is in the second stage (FIGS. 2C, 2D, and 6) and therefore connected to a cable connector 500 disposed in the corresponding second orifice 200 of the connector housing 102. The retention clip 104 and the clip receiving portion 202 are adapted so that the rounded engagement surface 302 of the retention clip 104 engages a corresponding annular groove 502 in the cable connector 500 (FIG. 5) when the retention clip 104 is positioned in the second stage (FIGS. 2C, 2D, and 6) and does not engage the corresponding annular groove 502 in the cable connector 500 when the retention clip 104 is positioned in the first stage (FIGS. 1, 2A, and 2B). By engaging the annular groove 502 in a cable connector 500, the retention clip 104 maintains, or locks, the cable connector 500 in the proper position in the connector housing 102.

Figure 5:
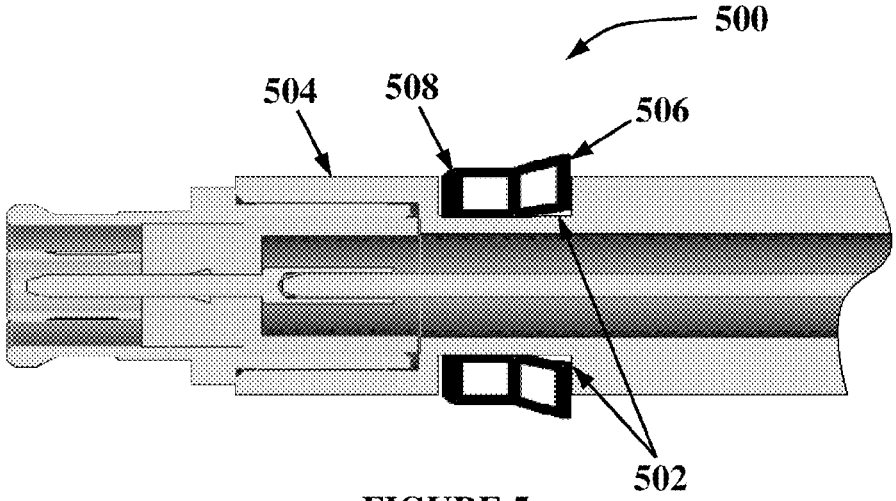
FIGURE 5 (PRIOR ART)
FIG. 5 is a sectional view illustrating a cable connector with a c-shaped retention clip.

FIG. 5 illustrates cable connectors 500 that may be used with the multi-port cable connector 100. Each cable connector 500 includes an annular groove 502 disposed in the conductive body 504 thereof that is adapted to receive a c-shaped retaining ring 506 therein. The retaining ring 506 includes a tapered outer surface 508 that extends beyond the conductive body 504 of the cable connector 500 and is adapted to engage a corresponding annular groove in a connector housing so as to secure the cable connector 500 therein. The retaining ring 506 is formed of resilient material so that, as the cable connector is installed in a connector housing, the tapered outer surface 508 engages the edge of an opening in the connector housing and causes the retaining ring 506 to bias inwardly to a smaller diameter until it passes through the opening and into the corresponding annular groove 502 in the connector housing 102. When the retaining ring 506 passes into the corresponding annular groove 502, the retaining ring 506 is biased outwardly to engage the annular groove, thereby locking the cable connector 500 in position within the connector housing.

Because of the retaining ring 506, a special tool is required to remove the cable connector 500 from conventional connector housings. The special insertion tool is needed to bias the retaining ring 506 inwardly and disengage it a corresponding annular groove in the conventional connector housing. The special tool cannot be inserted from a rear area of the connector housing. Thus, not only is it difficult to access and depress the retaining ring 506 in that manner, the entire connector housing must be removed from an electronic component to remove a single cable connector.

The connector housing 102 and retention clips 104 of present invention eliminate the need for a retaining ring 506 on the cable connector 500 and a special insertion tool and allow each cable connector 500 to be removed individually without removing the entire multi-port cable connector 100. Moreover, the connector housing 102 and retention clips 104 of present invention can be adapted to mate with substantially any preexisting cable connector 500 designed with an annular groove 502, which provides reverse compatibility between the multi-port cable connector 100 and cable connectors 500 such as the AMPHENOL MCX brand coaxial cable connectors.

As FIG. 6 illustrates, when a retention clip 104 is positioned in the second stage (FIGS. 2C, 2D, and 6), the rounded engagement surface 306 of the retention clip 104 engages the annular groove 502 in the cable connector 500, thereby locking the cable connector 500 in position within the connector housing 102. The surfaces where the retention clips 104 engage the corresponding cable connectors 500 are dimensioned to retain each cable connector 500 within the connector housing 102 while providing enough radial float, or movement, to allow the cable connectors 500 to be blind mated. For example, the retention clips 104 and cable connectors 500 may be dimensioned to provide 0.030 inches (0.8 millimeters) of radial float and 0.040 inches (1.0 millimeters) of axial float for either 50 Ohm or 75 Ohm cable connectors 500.

As FIG. 6 also illustrates, the chamfered edge 310 of the retention clip's 104 tongue portion 302 creates a tool access 600 between the tongue recess 204 of the connector housing 102 and the retention clip 104 at the trailing wall 206 of the connector housing 102. Accordingly, a user can access each individual retention clip 104 from an area behind an installed multi-port cable connector 100 without removing the entire multi-port cable connector 100 from the electronic component. Instead of removing the entire multi-port cable connector 100, the tip of a standard tool, such as a flathead screwdriver, can be inserted in the tool access 600 to provide upward force to the tongue portion 302 and move the retention clip 104 from the second stage (FIGS. 2C, 2D, and 6) to the first stage (FIGS. 1, 2A, and 2B) and/or to remove each individual cable connector 500 from the connector housing 102. Similarly, each individual retention clip 104 may be installed in the connector housing and/or moved from the first stage (FIGS. 1, 2A, and 2B) to the second stage (FIGS. 2C, 2D, and 6) by applying downward force to the main body 300 or tongue portion 302 of the retention clip 104.

A further advantage of the multi-port cable connector 100 of the present invention is that, by providing two stages for engaging the retention clips 104 within the clip receiving portions 202, the retention clips 104 maintain their respective positions in the connector housing 102 in both stages and will not fall out of the connector housing 102. Accordingly, retention clips 104 will not be misplaced as easily and the multi-port cable connector 100 can be shipped with the retention clips 104 pre-installed, preferably in the first stage (FIGS. 2A and 2C).

In addition, by disposing the retention clips 104 wholly within the connector housing 102 and providing access to each retention clip 104 from an area behind the multi-port cable connector 100 relative to the electronic component, the multi-port cable connectors 100 of the present invention can be stacked in close proximity to each other on an electronic component, such as a headend. And, even though the multi-port cable connectors 100 may be densely populated on an electronic component, each retention clip 104 remains individually accessible to allow the installation or removal of individual cable connectors 500 at any one of the many cable ports in each multi-port cable connector 100 without having to remove the entire multi-port cable connector 100 from the electronic component.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A multi-port cable connector, comprising of:

a connector housing having a plurality of orifices and a clip receiving portion extending into each orifice, each orifice being adapted to receive a corresponding cable connector therein and each clip receiving portion including at least one grooved engagement surface disposed in a sidewall of the clip receiving portion and defining a first stage, and at least one second grooved engagement surface disposed below the at least one first grooved engagement surface in a sidewall of the clip receiving portion and defining a second stage; and a plurality of retention clips adapted to slide between the first stage and the second stage in a corresponding clip receiving portion, each retention clip including a pair of engagement arms having a notched engagement surface for alternately engaging the pair of first engagement surfaces and the pair of second engagement surfaces.

2. The multi-port cable connector of claim 1, wherein each retention clip includes a rounded engagement surface extending therefrom that is adapted to engage an annular groove disposed in a corresponding cable connector when the retention clip is in the second stage and to not engage the annular groove in the corresponding cable connector when the retention clip is in the first stage.

3. The multi-port cable connector of claim 1, wherein at least one retention clip is accessible from a rear area of the connector housing, the rear area being located on a side of the connector housing opposite an electronic component to which the multi-port cable connector is attached.

4. The multi-port cable connector of claim 1, wherein at least one retention clip extends beyond an outer surface of the connector housing when that retention clip is in the first stage and the at least one retention clip is substantially flush with the outer surface of the connector housing when that retention clip is in the second stage.

5. The multi-port cable connector of claim 1, wherein at least one retention clip includes a tongue portion for providing leverage for moving the retention clip back and forth between the first stage and the second stage.

6. The multi-port cable connector of claim 5, wherein the connector housing includes at least one tongue recess disposed in an outer surface thereof that is adapted to receive the tongue portion therein so that the retention clip is substantially flush with the outer surface of the connector housing when the retention clip is in the second stage.

7. The multi-port cable connector of claim 5, wherein the tongue portion is accessible from a rear area of the connector housing, the rear area being located on a side of the connector housing opposite an electronic component to which the multi-port cable connector is attached.

8. The multi-port cable connector of claim 7, wherein the tongue portion includes a chamfered edge for receiving a standard tool between the tongue portion and the connector housing at the rear area of the connector housing.

9. The multi-port cable connector of claim 1, wherein at least one clip receiving portion includes a tapered opening for receiving a retention clip therein.

10. The multi-port cable connector of claim 1, wherein at least one of the connector housing and the plurality of retention clips is formed from a lightweight dielectric material.

11. The multi-port cable connector of claim 1, wherein the lightweight dielectric material is 15% glass filled Polybutylene Terephthalate (PBT).

12. A method for making a multi-port cable connector, comprising the steps of:

forming a connector housing with a plurality of orifices and a clip receiving portion extending into each orifice, each orifice being adapted to receive a corresponding cable connector therein and each clip receiving portion including at least one grooved engagement surface disposed in a sidewall of the clip receiving portion and defining a first stage, and at least one second grooved engagement surface disposed below the at least one first grooved engagement surface in a sidewall of the clip receiving portion and defining a second stage;

forming a plurality of retention clips adapted to slide between the first stage and the second stage in a corresponding clip receiving portion, each retention clip including a pair of engagement arms having a notched engagement surface for alternately engaging the pair of first engagement surfaces and the pair of second engagement surfaces; and installing at least one of the retention clips in at least one of the clip receiving portions.

13. The method of claim 12, wherein each retention clip is formed with a rounded engagement surface extending therefrom that is adapted to engage an annular groove disposed in a corresponding cable connector when the retention clip is in the second stage and to not engage the annular groove in the corresponding cable connector when the retention clip is in the first stage.

14. The method of claim 12, wherein the connector housing is formed so that at least one retention clip is accessible from a rear area of the connector housing, the rear area being located on a side of the connector housing opposite an electronic component to which the multi-port cable connector is attached.

15. The method of claim 12, wherein the connector housing and at least one retention clip are formed so the at least one retention clip extends beyond an outer surface of the connector housing when that retention clip is in the first stage and the at least one retention clip is substantially flush with the outer surface of the connector housing when that retention clip is in the second stage.

16. The method of claim 12, wherein at least one retention clip is formed with a tongue portion for providing leverage for moving the retention clip back and forth between the first stage and the second stage.

17. The method of claim 16, wherein the connector housing is formed with at least one tongue recess disposed in an outer surface thereof that is adapted to receive the tongue portion therein so that the retention clip is substantially flush with the outer surface of the connector housing when the retention clip is in the second stage.

18. The method of claim 16, wherein the connector housing and the tongue portion are formed so the tongue portion is accessible from a rear area of the connector housing, the rear area being located on a side of the connector housing opposite an electronic component to which the multi-port cable connector is attached.

19. The method of claim 18, wherein the tongue portion is formed with a chamfered edge for receiving a standard tool between the tongue portion and the connector housing at the rear area of the connector housing.

20. The method of claim 12, wherein at least one clip receiving portion is formed with a tapered opening for receiving a retention clip therein.

21. The method of claim 12, wherein at least one of the connector housing and the plurality of retention clips is formed from a lightweight dielectric material.

22. The method of claim 12, wherein the lightweight dielectric material is 15% glass filled Polybutylene Terephthalate (PBT).

* * * * *